US006607331B2

(12) United States Patent
Sanders et al.

(10) Patent No.: US 6,607,331 B2
(45) Date of Patent: Aug. 19, 2003

(54) ELEVATED CRANE SUPPORT SYSTEM AND METHOD FOR ELEVATING A LIFTING APPARATUS

(76) Inventors: Ronald E. Sanders, 74045 Military Rd., Covington, LA (US) 70435; Paul Butler, 1620 Carol Sue Apt 511, Terrytown, LA (US) 70056

( * ) Notice: Subject to any disclaimer, the term of this patent is extended or adjusted under 35 U.S.C. 154(b) by 0 days.

(21) Appl. No.: 09/931,270

(22) Filed: Aug. 15, 2001

(65) Prior Publication Data

US 2002/0079278 A1 Jun. 27, 2002

Related U.S. Application Data

(60) Provisional application No. 60/226,268, filed on Aug. 17, 2000.

(51) Int. Cl.[7] ..... E02B 17/08; B66C 23/53

(52) U.S. Cl. ..... 405/196; 405/195.1; 405/203; 212/175; 212/307; 212/309

(58) Field of Search ..... 405/195.1, 196, 405/197, 198, 203–208; 212/175, 253, 307, 311

(56) References Cited

U.S. PATENT DOCUMENTS 3,977,346 A * 8/1976 Natvig et al. ..... 114/264 X
3,991,581 A * 11/1976 Kolb ..... 405/227
4,081,932 A * 4/1978 Armstrong ..... 405/201 X
4,084,385 A * 4/1978 Boyadjieff ..... 175/5 X
4,271,578 A * 6/1981 Robinson et al. ..... 211/175 X
4,417,664 A * 11/1983 Gordon ..... 212/192
4,652,177 A * 3/1987 Gunther, Jr. et al. ..... 405/196
5,580,189 A * 12/1996 Sanders et al. ..... 405/198
6,203,247 B1 * 3/2001 Schellstede et al. ..... 405/196
6,390,732 B1 * 5/2002 Kristensen et al. ..... 405/203 X

FOREIGN PATENT DOCUMENTS

JP 60152724 * 8/1985 ..... 405/228

* cited by examiner

*Primary Examiner*—Jong-Suk (James) Lee
(74) *Attorney, Agent, or Firm*—Joseph T. Regard, Ltd, PLC

(57) ABSTRACT

A support structure for supporting a lift crane, and in particular to a lift crane jack-up structures, including rigs, platforms, barges, boats or the like, wherein the lift crane is positioned about a leg of the jack-up structure atop the jack-house. The preferred embodiment of the present invention contemplates a system for elevating a lift crane above the deck and about the leg of the jack-up structure, without relying upon the leg for structural support. A structurally reinforced jack-house having jacking units interfacing with the leg is provided at the deck of the vessel the jack-house configured to engage and support a crane tube column upon the roof of the jack house, which crane tube column in turn has situated thereupon the lift crane.

9 Claims, 13 Drawing Sheets

JACK HOUSE C/S
26'-0" ABOVE
MAIN DECK

ELEVATED CRANE SUPPORT SYSTEM AND METHOD FOR ELEVATING A LIFTING APPARATUS

PRIORITY CLAIM

The present application claims the benefit of U.S. Provisional Application Ser. No. 60/226,268 for Jack-House Mounted, Elevation Supported Apparatus and Method for Jack-Up Structures, having a filing date of Aug. 17, 2000, listing as inventors Ronald E. Sanders and Paul Butler.

TECHNICAL FIELD OF THE INVENTION

The present invention relates to a support structure for supporting a lift crane and in particular to lifting cranes for use on jack-up type drilling rigs, lift boats, platforms, boats and the like, wherein the lift crane is positioned about a leg(s) of the jack-up structure atop the jack-house or yoke assembly.

The preferred embodiment of the present invention contemplates a system for elevating a lift crane above the deck and about the leg of the jack-up structure, without relying upon the leg for structural support, unlike king post-type design lift cranes. A structurally reinforced jack-house or yoke assembly having jacking units interfacing with the leg, is provided at the deck of the vessel. The jack-house or yoke assembly is configured to engage and support a crane tub upon the top of the jack-house or yoke assembly, which crane tub has situated thereupon the lift crane.

The structurally designed jack-house or yoke assembly allows one to support a crane above the deck in a stable manner independent of the leg situated there through, so as to provide a superior structural support for the lift crane, while providing ample space within the jack-house or yoke assembly for the jacking units. The combined jack-house/yoke assembly support structure thereby affords significant space savings upon the deck of the platform, while providing enhanced support of the lift crane.

BACKGROUND OF THE INVENTION

Both jack-up drilling rigs and lift boats are well known in the art. These vessels are moved from one location to another via a floating hull. Lift boats are self-propelled while jack-up drilling rigs are towed to a location. Lift boats have cylindrical pipe legs while jack-up drilling rigs tend to have truss legs. However, some older generation jack-up drilling rigs have pipe legs. Once the vessel has reached the desired location, the legs are lowered to the seabed.

The hull continues to be lifted until it is above the water's surface. When the vessel reaches the desired height above the water's surface, the vessel provides a stable work area to perform various operations. As in the case with a jack-up drilling rig, the vessel is used to explore for oil and/or gas. In the case of the lift boat, a number of work related activities could be accomplished once the vessel has reached its operational position. Generally, lift boats have not been used in actual drilling operations. Both vessels employ the use of various crane arrangements to facilitate operations.

A list of patents which may have some pertinence to the present invention include:

| Pat. No. | Inventor | Date of Issue |
|---|---|---|
| 4,417,664 | Gordon | Nov. 29, 1983 |
| 4,652,177 | Gunther, Jr et al | Mar. 24, 1987 |
| 5,580,189 | Sanders et al | Dec. 3, 1996 |

In the past, cranes have been mounted in essentially three configurations on jack-up vessels. First, the most common method is to mount the crane in a strategic location on the deck. The drawbacks of this mounting method have been both using up valuable deck space and the legs getting in the way of the movement of the hook load.

A second method that has been employed on cylindrical pipe leg lift boats has been to mount the crane around the pipe leg/cylindrical guide tower utilizing a pair of resilient pads spaced apart to enable rotation of a cylinder around the leg (See U.S. Pat. No. 4,652,177, Gunther, Jr. et al, Mar. 24, 1987).

Another patent was issued that provided a method and apparatus for mounting lift cranes on cylindrical pipe leg vessels using a pair of bearing races spaced apart to allow for unencumbered vertical movement of the leg (See U.S. Pat. No. 4,417,664, Gordon, Nov. 29, 1983). The third method of mounting the crane is to mount the crane around the leg with the ring beam base mounted directly on the deck of the vessel about the leg (U.S. Pat. No. 5,580,189, Sanders et al, Dec. 3, 1996).

Jack-up vessels utilizing truss type legs require a jack-house or yoke assembly to provide the necessary structural integrity for the upper guide assembly. A jack-house is generally a square or rectangular structure designed to provide the necessary structural integrity to support the upper guide assembly. The guides on a jack-up vessel are used to guide the legs through the hull as the legs are being elevated or lowered. A yoke assembly is another method to tie the upper guides structurally to the hull. The lower guide assembly is generally incorporated into the lower part of the hull. The motors and gears (gear case) used to lift and lower the legs in some cases are attached to this jack-house or yoke assembly. However, the upper guides and the gear cases may be separate and independent of each other.

Deck space is at a premium on jack-up vessels and deck mounted cranes take up valuable space. Lift cranes employing a tubular tower arrangement are limited to the maximum diameter of cylindrical pipe leg vessel designs thus limiting the working water depth of the vessel.

In summary would appear that the prior art has failed to contemplate a lift crane and support structure therefore which provides the lift capability and stability of a deck mounted crane, but mounted in an elevated fashion about a leg upon a jack-up structure, while providing space savings and a cost effective design.

GENERAL SUMMARY DISCUSSION OF THE INVENTION

The present invention contemplates a lift crane and support-structure-system which provides space efficiency in the form of an elevated support above the deck but with more enhanced capabilities than tubular tower arrangements and deck mounted cranes.

The vessel of the present invention utilizes a conventional jacking mechanism to elevate and lower the legs while the jacking units are independently supported upon the deck in the vicinity of each leg. In the preferred embodiment of the present invention, a structurally reinforced jack-house or yoke assembly having jacking units interfacing with the leg is provided at the deck of the vessel. Unlike traditional jack-houses or yoke assemblies which are used to only provide the necessary structure for the upper guide assembly and/or the gear cases, the jack-house or yoke assembly of the present invention is substantially reinforced structurally to support a crane tub thereupon, which the crane tub in turn has situated the lift crane.

The jack-house, although from the exterior may appear to be similar to prior art jack-houses, employs significant structural reinforcement to withstand the heavy tonnage loads which may be exerted upon it by the lift crane in operation. The jack-house utilizes extensive vertical structural support within its walls, which can be in the form of box/tubular beams, T-beams, or I-beams, which run through the deck to the hull, interfacing with the frame of the vessel (longitudinal and transverse bulkheads) and providing a support perimeter along the top edges of the jack-house above the wall sections including the vertical structural supports.

Using the yoke assembly method of support, the diagonal bracing and support structure is likewise significantly structurally reinforced to withstand the crane loads. With the yoke assembly, additional diagonal bracing and support structure will be required based on crane structural requirements.

The circular crane tub is primarily supported upon the structurally enhanced jack-house. Further, within the hull, angled or bracing support members interfacing within the vessels longitudinal and transverse bulkheads are employed to support the vertical structural support members in a generally vertical support position. Box/tubular beams, T-beams, I-beams, or the like, whose ends engage the vertical structural supports, are situated below the horizontal upper surface or roof of the jack-house to add further structural stability to the roof. Using the yoke assembly method of mounting, the circular crane tub is similarly situated.

In the preferred embodiment of the present invention, a crane tub having an exterior diameter which is about the same as the width of the jack-house is situated upon the top of the jack-house so that the diameter of the crane tub engages the horizontal upper surface or roof of the jack-house above the vertical structural supports, so that the vertical structural support members support the crane tub. Portions of the crane tub, which do not engage the vertical structural supports, may engage the horizontal support employed below the roof of the jack-house.

The combined jack-house/crane tub design allows one to support a crane above the deck in a stable manner independent of the leg situated there through, so as to provide a superior structural support for the lift crane, while providing ample space within the jack-house for the jacking units. The combined jack-house/crane tub support structure thereby affords significant space savings upon the deck of the platform, while providing enhanced support of the lift crane.

The outer walls of the jack house are formed from heavy-duty planar support panels which are extensions of, or otherwise conjoined to corresponding longitudinal and transverse bulkheads within the substructure of the vessel, so as to provide a heavy duty load cell emanating through the deck of the vessel, so as to form a combined jack house structure/lifting apparatus support platform.

In an alternative embodiment of the present invention, an array of truss support beams are provided in communication with underlying longitudinal and transverse bulkheads in the vessel substructure (so as to form a "load cell), to provide a raised platform for the lifting apparatus, while providing an unencumbered, open area upon the deck under said platform for inspection of underlying gear cases and related components.

It is therefore an objective of the present invention to provide a lift crane support structure which utilizes a minimal amount of deck space.

It is another objective of the present invention to provide a lift crane support structure which supports the lift crane above the surface of the deck and about a jack-up leg, but does not rely upon the jack-up leg for structural support.

Another objective of the present invention is to provide a lift crane support structure which supports a lift crane above the surface of the deck but with greater structural stability and capacity than other prior art designs.

Lastly, it is an objective of the present invention to provide a method and system for supporting a lift crane over the deck of a vessel and about a jack-up leg, which the system further employs a structurally enhanced jack-house as a component of the support system and also is utilized to shelter the jacking units in an unencumbered fashion.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
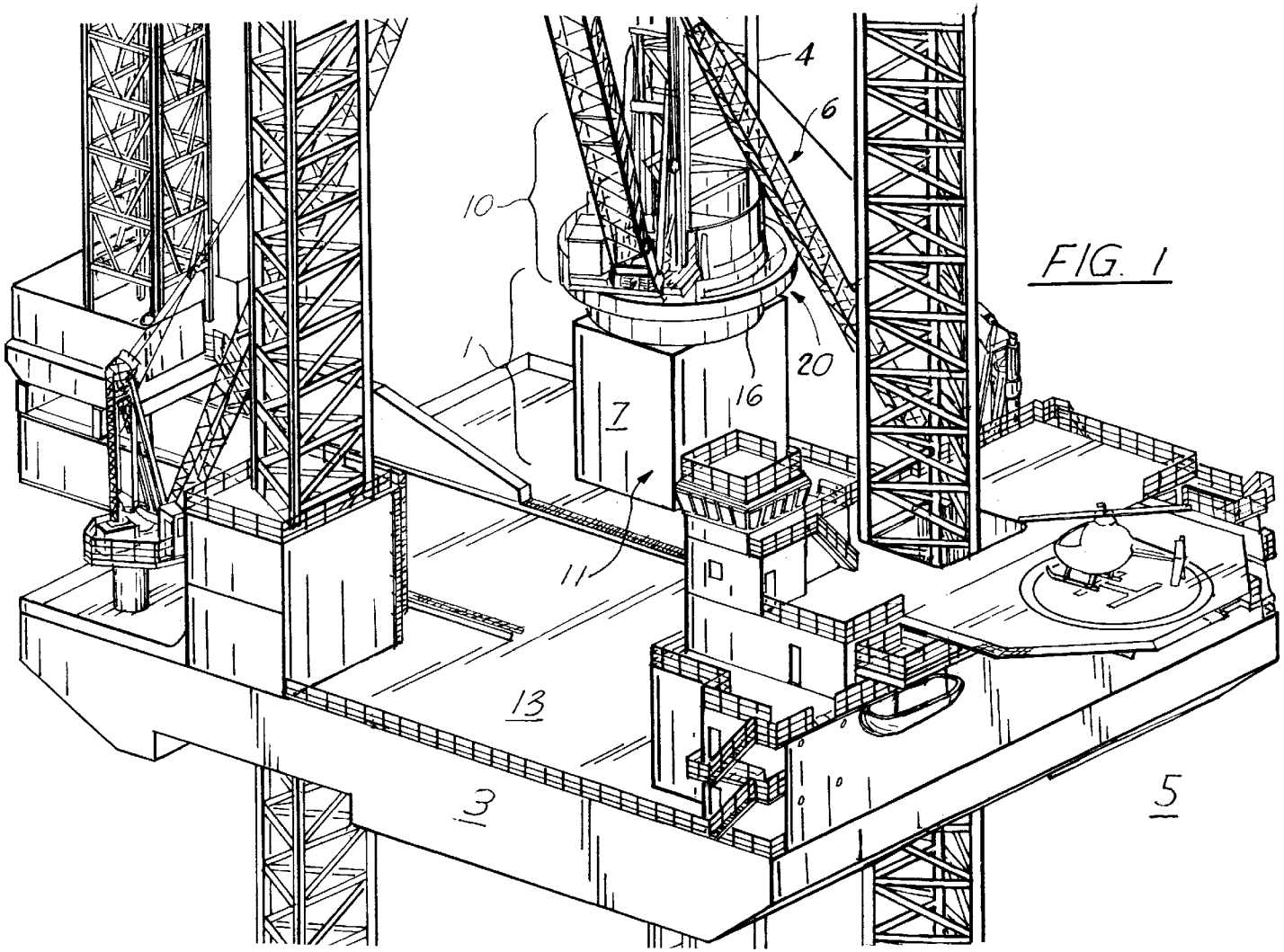
FIG. 1 is an isometric view of an exemplary jack-up vessel having the lift crane support structure/jack house of the present invention.

Referring to FIG. 1 of the drawings, the lift crane support structure/jack-house 1 of the present invention is integrated into the deck 13 of a vessel 3 such as a jack-up drilling rig, jack-up service vessel, barge, platform, or the like having legs 4 configured to engage the water bottom 5 to lift the vessel above the water level, the legs 4 passing through vertical, enveloped passageways 6 formed through the deck and hull of the vessel. To facilitate lifting or lowering of the legs 4, jacking units 11, 11' are provided, generally within a jack-house 7.

In order to provide a more stable, elevated platform for a crane to operate on the vessel, while lessening deck space requirements, the jack-house of the present invention is reinforced to allow the placement of a crane tub 16 emanating from the top of the jack-house, which crane tub has at its distal end a flange 20 for the rotatable engagement of a crane 10 thereupon.

Continuing with FIGS. 2A–2C, 3A–3C, and 4A–4C, the jack-house 7', 7" of the preferred embodiment of the present invention comprises an above deck portion 12, 12' and a substructure 14, 14' situated below deck 13, 13' such that the jack-house is structurally integrated into the vessel, with the base of the jack-house engaging the hull 19, 19' of the vessel in the vicinity of the leg passageway 6' for leg 4'. Below the deck, the jack-house substructure 14, 14' may be reinforced by diagonal braces of support members 17, 17" having first 17' and second 18 ends, the first end 17' engaging the jack-house wall members, the second end 18 engaging a bulkhead or otherwise inside of the hull 19, 19'.

As shown, the jack-house houses jacking units 11 are configured to engage the leg for vertical manipulation of same, which jacking units may be further protected by shelter 15, 15'.

Situated upon the top of jack-house 7' is a crane tub 16, 16' or pedestal having flange 20, 20' situated thereupon, which flange is configured to support crane 10, 10'. An exemplary crane which may be utilized with this system would be the AmClyde Unit Model 300ATL, a 300 Ton crane.

Figure 2A:
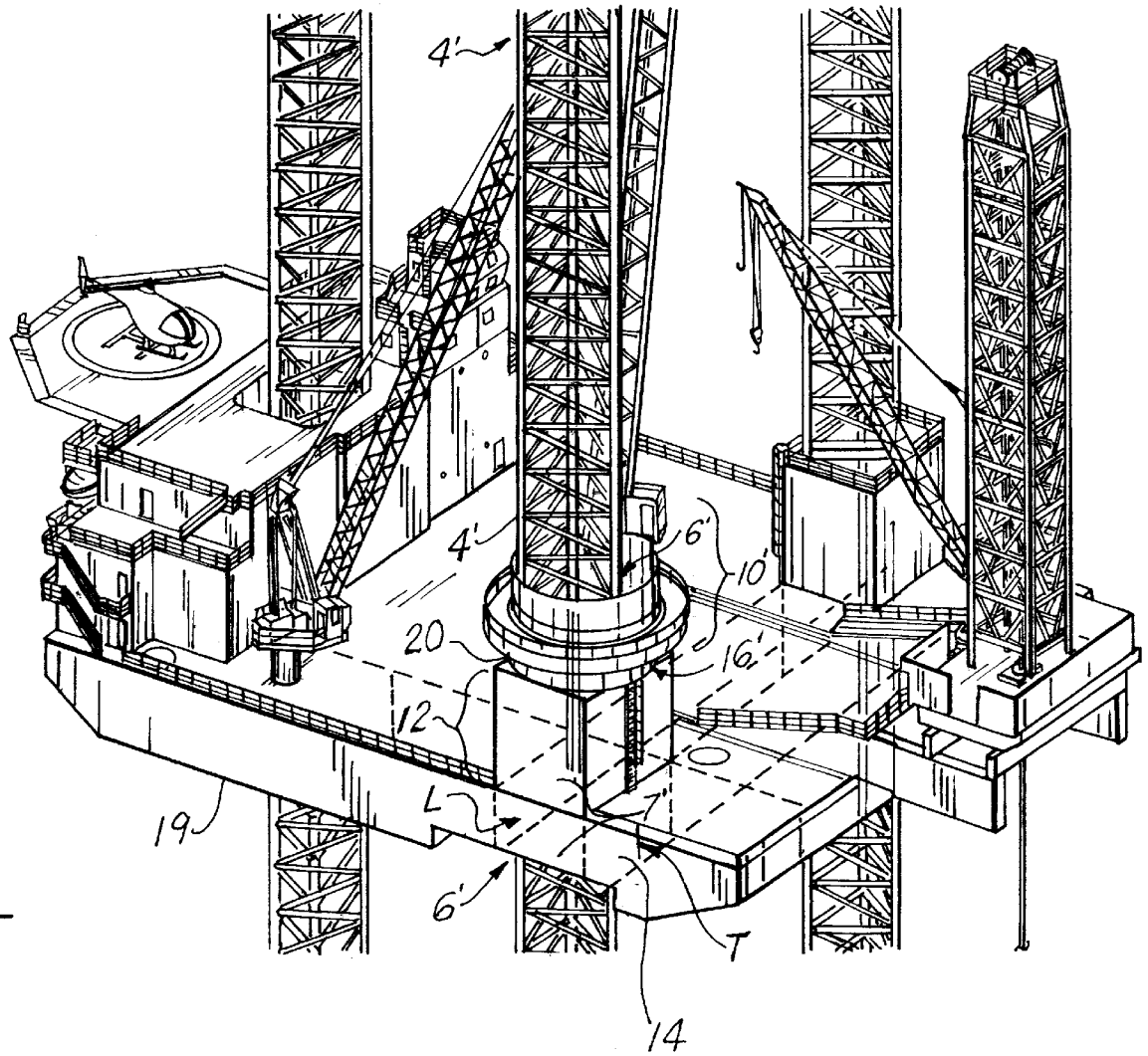
FIG. 2A is a side, partially cut-away view of a jack-up platform having the lift crane support structure/jack house of the present invention with an exemplary 300 ton crane, illustrating the erection of a detachable rig kit.
Figure 2B:
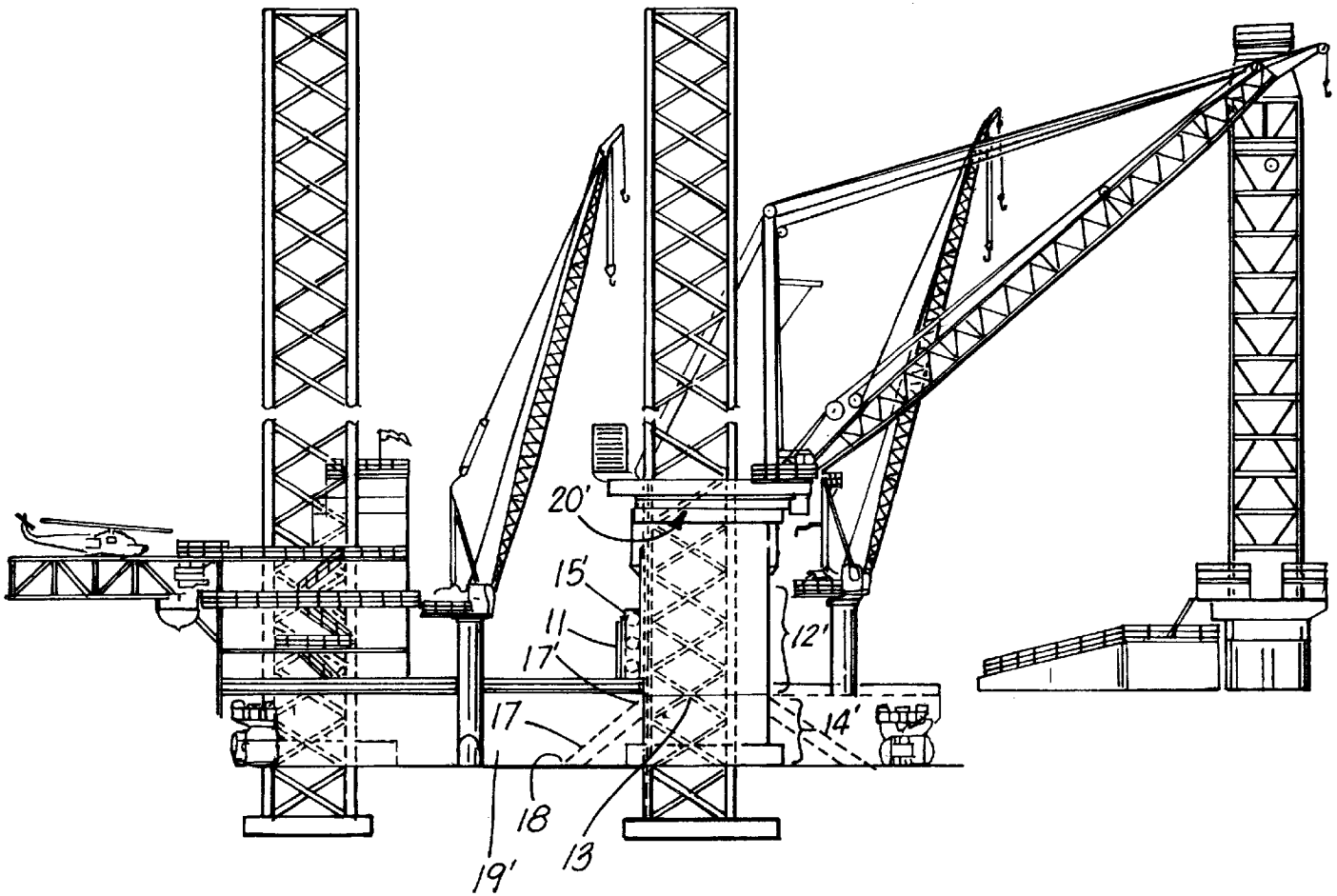
FIG. 2B is a side, partially cut-away view of the invention of FIG. 2A.
Figure 2C:
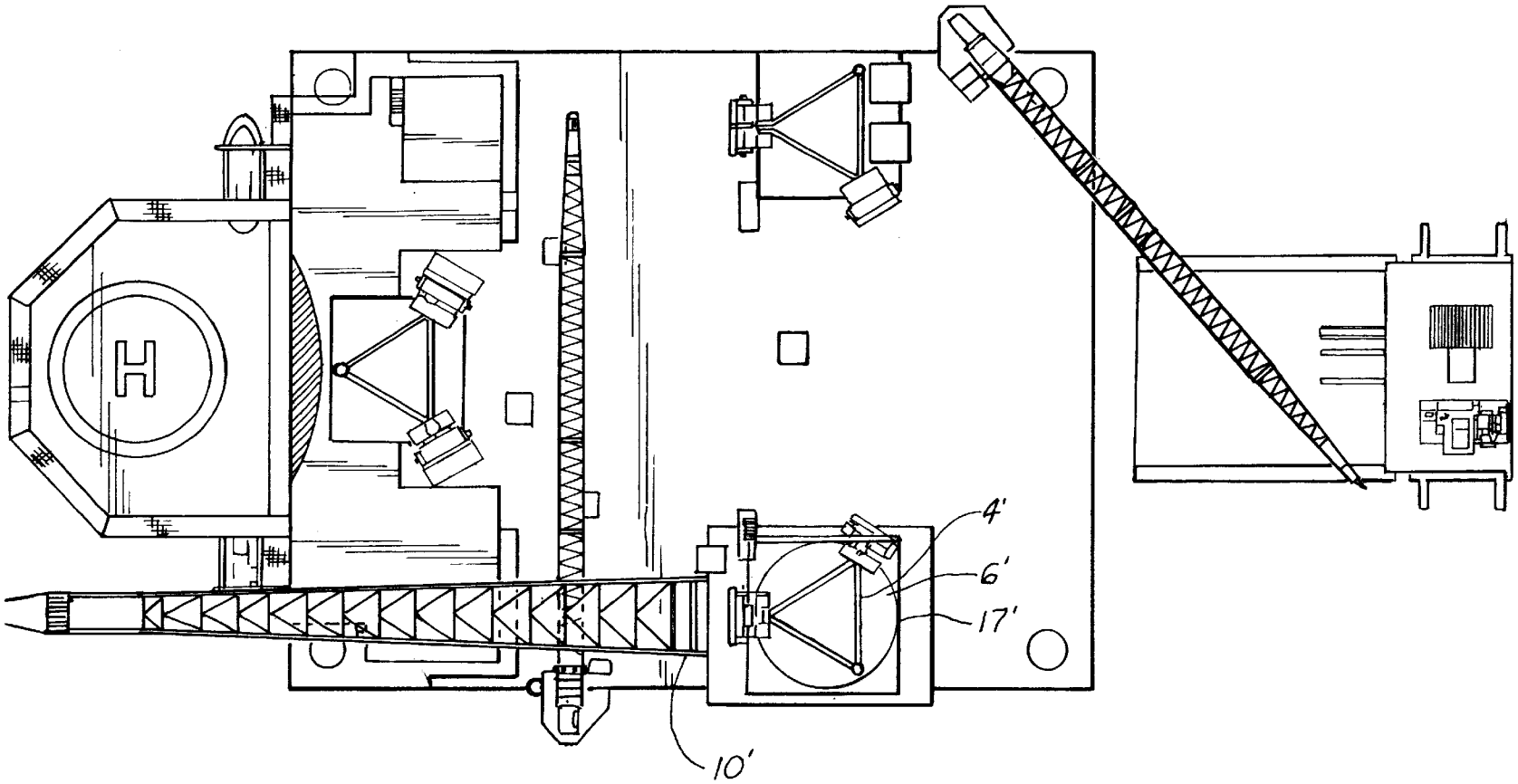
FIG. 2C is a top, partially cut-away view of the invention of FIG. 2B.
Figure 3A:
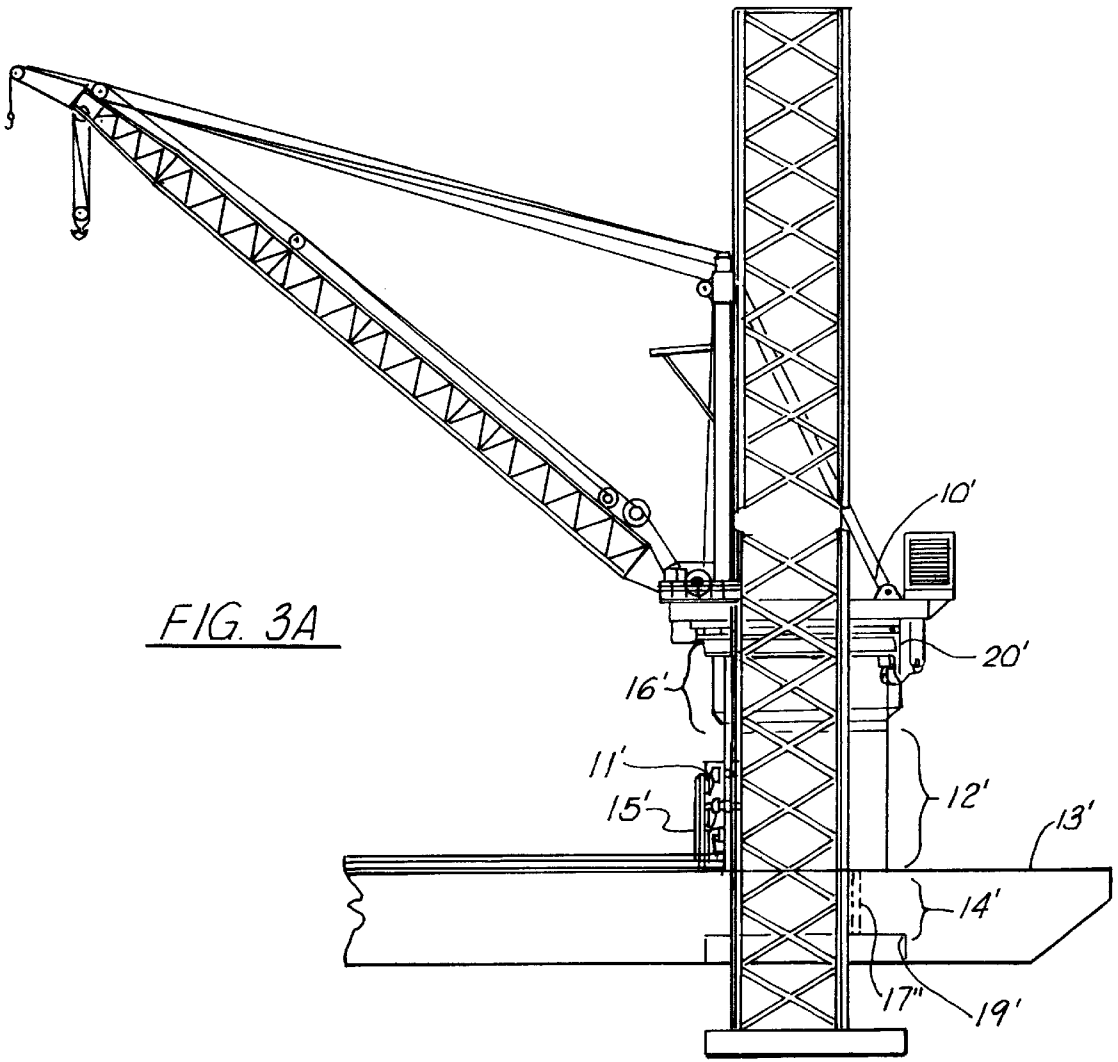
FIG. 3A is a side, partially cut-away, close-up view of a jack-up service boat having the lift crane support structure/jack house of the present invention.
Figure 3B:
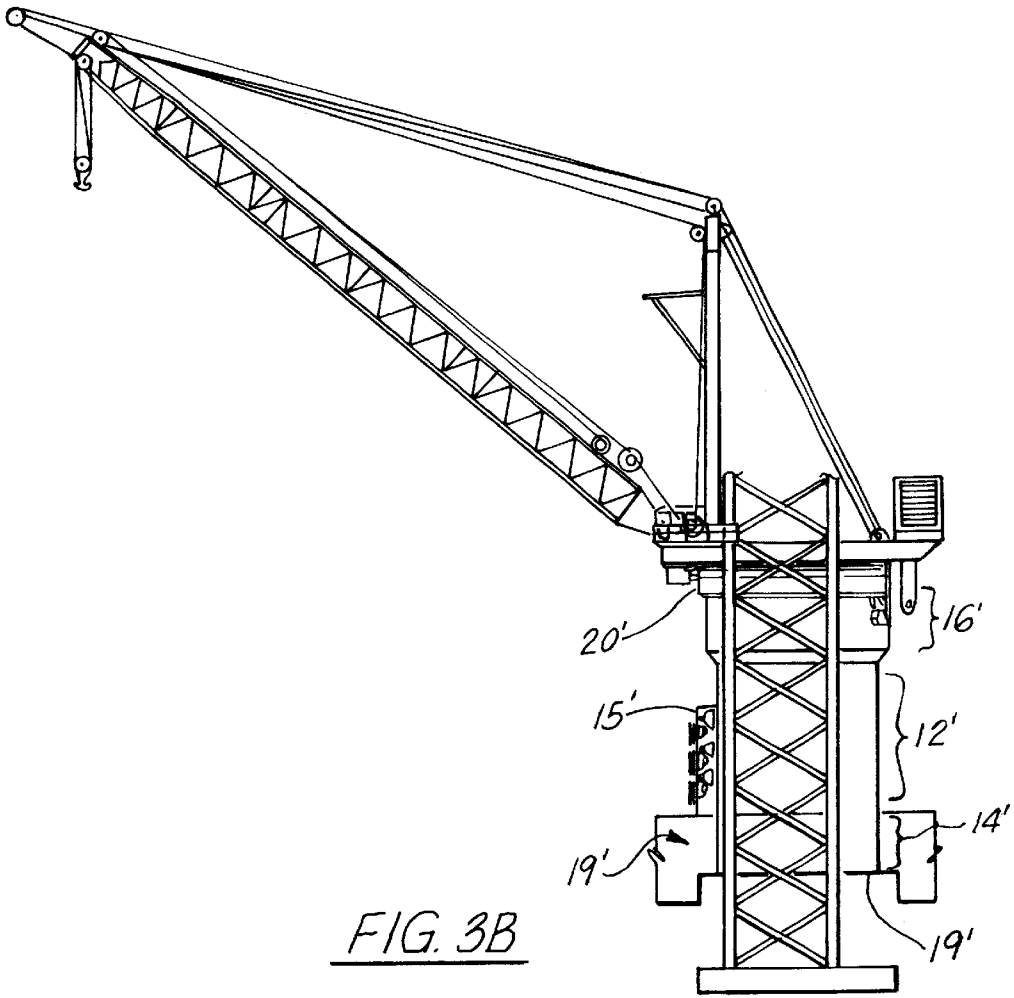
FIG. 3B is a side, partially cut-away, close-up view of the invention of FIG. 3A, illustrating the jack house integrated into the hull of the vessel, the crane tub situated atop the jack house, and the lift crane mounted thereupon.
Figure 3C:
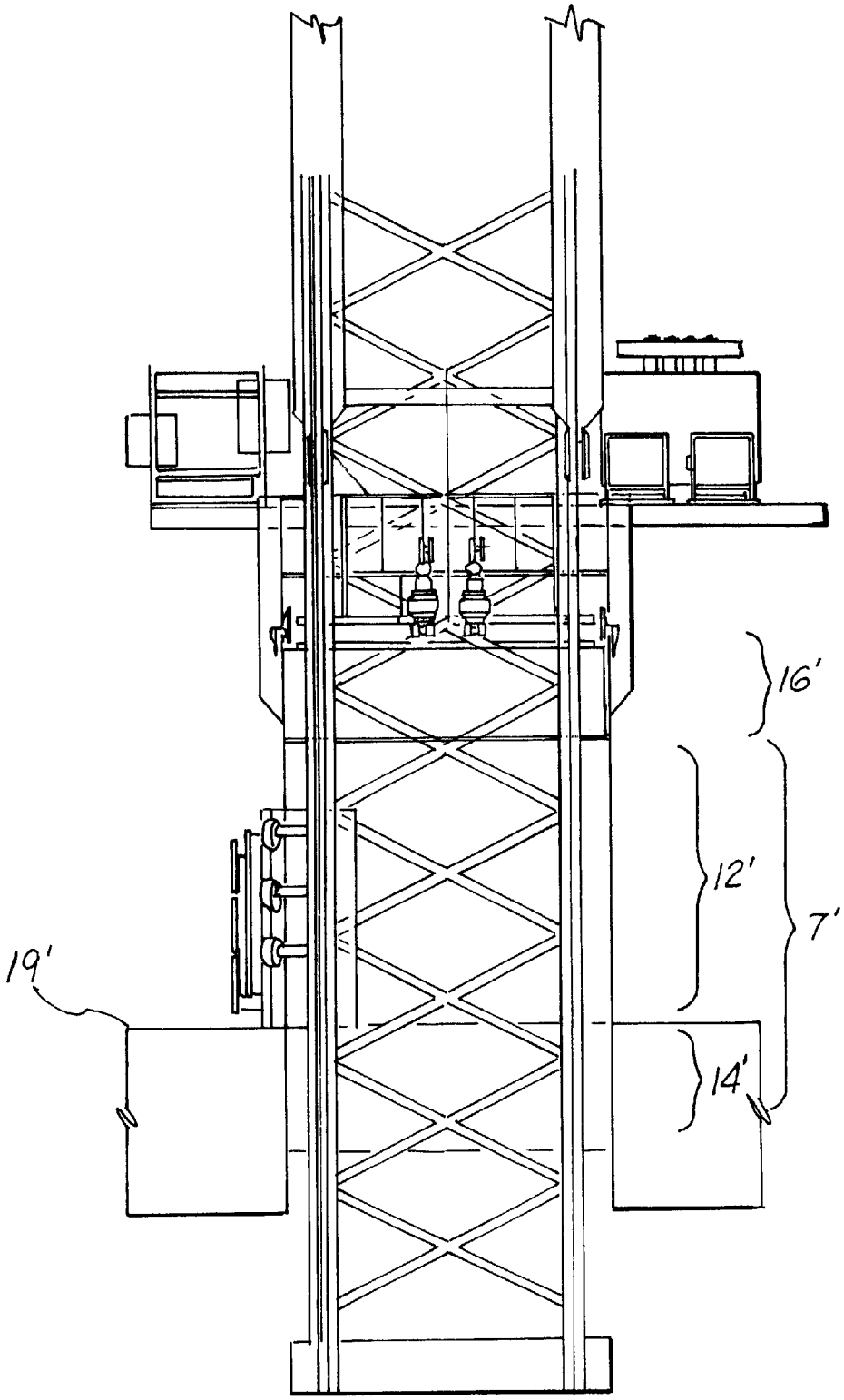
FIG. 3C illustrates still another side, partially cut-away, close-up view of the invention of FIG. 3B, illustrating the jack house integrated into the hull of the vessel, the crane-with a jack leg situated therethrough.
Figure 4A:
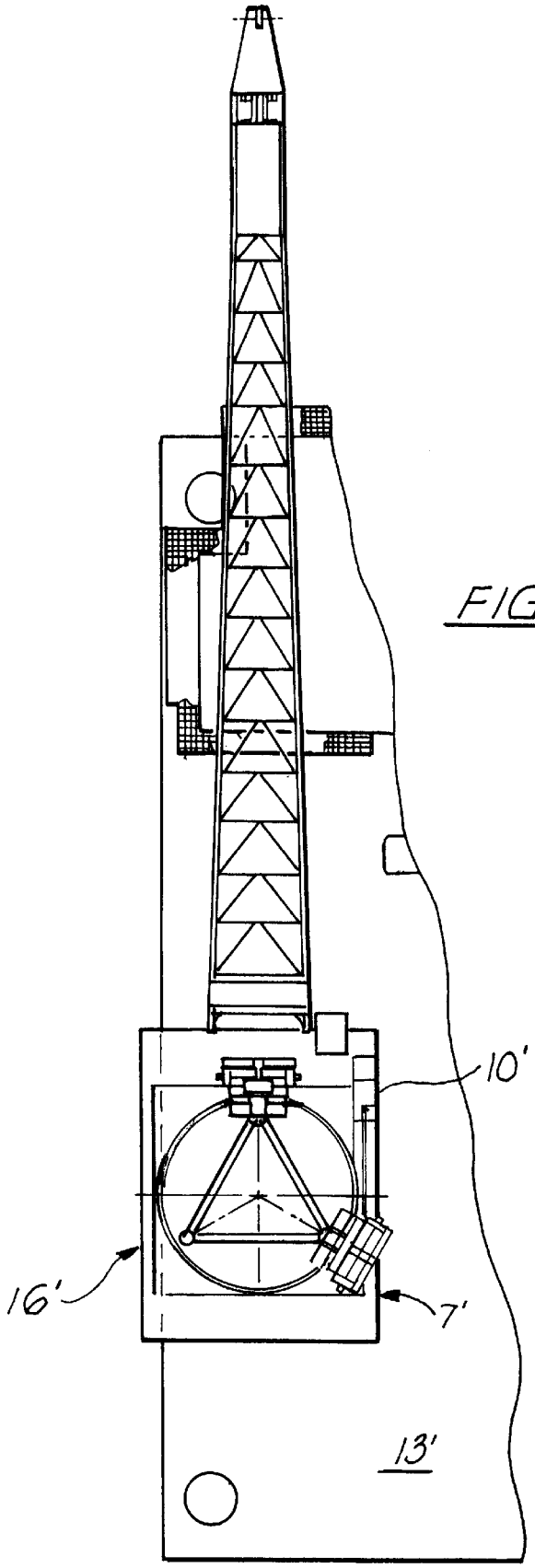
FIG. 4A illustrates a top view, partially cut-away view of the invention of FIG. 3A.
Figure 4B:
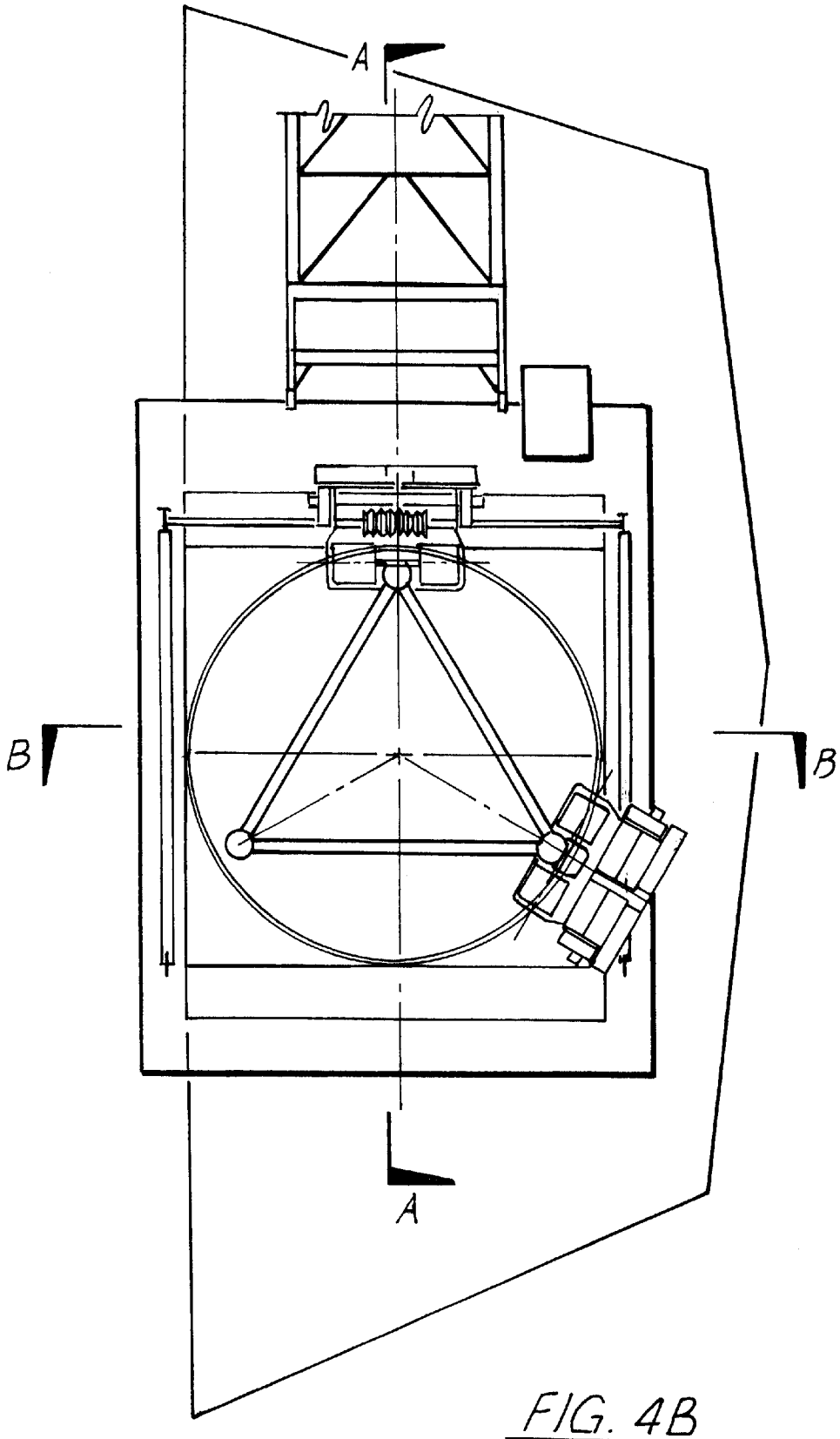
FIG. 4B is a top, partially cut-away, close-up view of the crane of the invention of FIG. 4A.
Figure 4C:
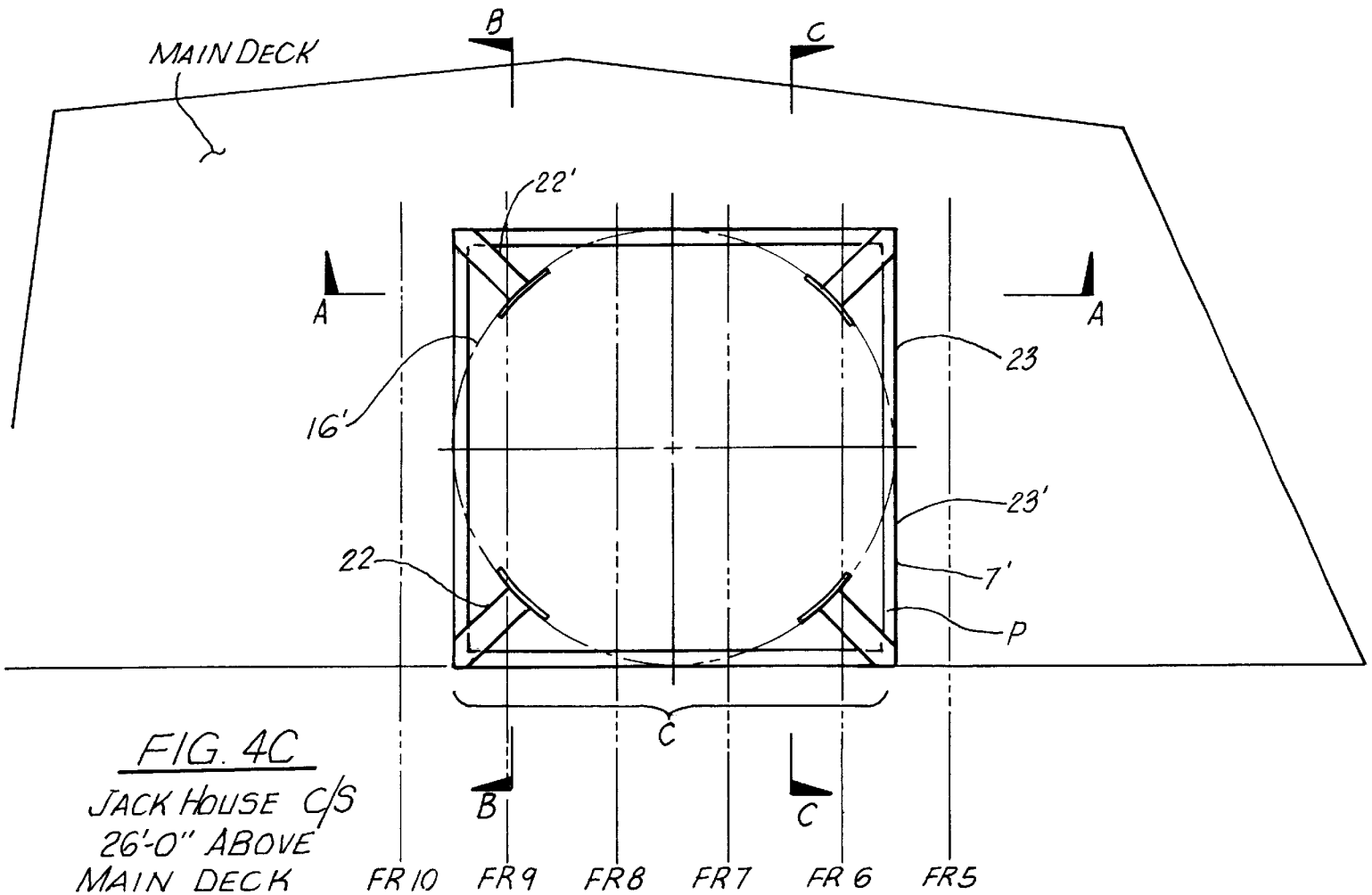
FIG. 4C is a top, cut-away view of the top of the jack house showing the four walls forming a square structure having integrated in the walls vertical supports, with horizontal supports reinforcing the top of the jack house, with the crane tub having a diameter about the width of the jack house, with the diameter centered about the walls and vertical supports of the jack house.

Continuing with FIG. 4C, which illustrates the top of the jack-house and the engagement of the crane tub 16' to the top of the jack-house 7', as well as FIG. 2A, in the preferred embodiment of the present invention, the jack-house 7, 7" forms a square vertical cross-section of the walls, with the width of the jack-house approximately coinciding with the diameter of the crane tub 16' so that the crane tub diameter rests upon the walls of the jack-house.

The walls of the jack-house are reinforced via vertical support members 23, 23' which may comprise multiple structural members such as box/tubular beams, I-beams, T-beams, or ideally solid plate (for example, 1½–2" high strength steel), or the like, running from the top of the jack-house, through the deck, and engaging the hull of the vessel via interfacing with longitudinal L and transverse T bulkheads so as to form a high strength, structurally reinforced lifting cell C comprising four vertical walls joined to form a multi-planar cellular structure having a perimeter P, said walls resting upon the hull of the vessel and forming a vertically situated, planar support structure through the deck of the vessel, the raised area emanating from the deck providing a raised platform for the crane or other equipment, while functioning as a jack-house enclosing the machinery for manipulating a leg 4' of the vessel. As earlier indicated, structural supports, angled stiffeners and/or braces or the like may be provided under the deck to support the vertical support members.

Cut-out areas may be provided through the walls and structural supports of the jack-house in the vicinity of the jacking units to allow same to engage the legs. Horizontal supports 22, 22' may be provided in the ceiling of the jack-house for further structural support of the pedestal and crane.

A second embodiment of the present invention utilizing a substructure similar to that employed in the preferred embodiment, provides an open deck structure where a jack house is not desirable. Instead of the jack house walls for supporting the platform, the second embodiment employs a non-planar support in the form of a truss-type bracing assembly to form a support structure above the deck of the vessel.

Figure 5A:
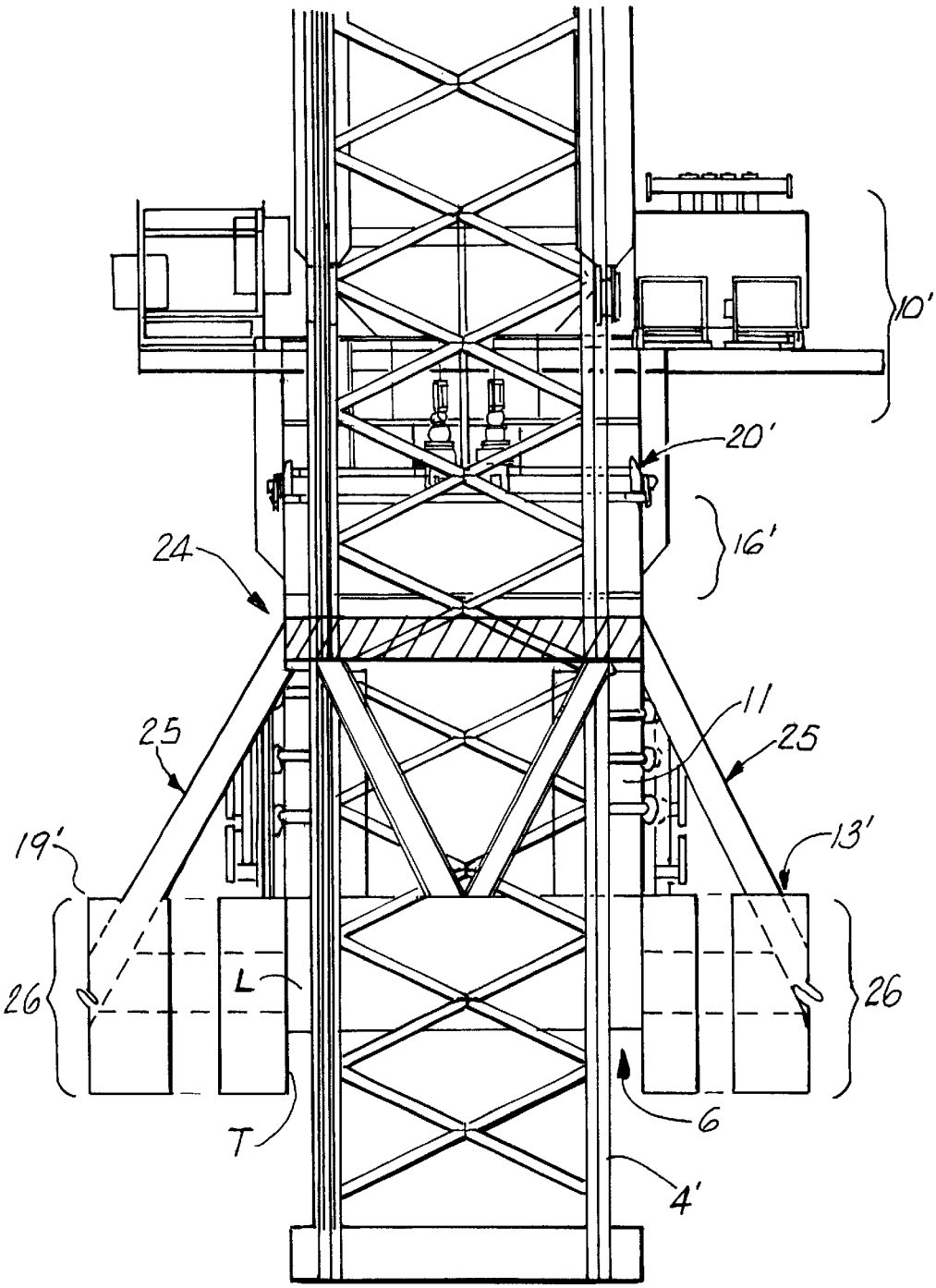
FIG. 5A is a side view of an alternative embodiment of the present invention, illustrating an array of truss support beams in a lattice arrangement to form a yoke assembly for placement of the crane tub thereupon.

Referring to FIG. 5A, in order to provide a more stable, elevated platform for a crane to operate on the vessel, while lessening deck space requirements, a yoke assembly 24 comprising a lattice arrangment of bracing members of the present invention is reinforced to allow the placement of a crane tub 16' emanating from the top of the yoke assembly 24, which crane tub 16' has at its distal end a flange 20 for the rotatable engagement of a crane 10' thereupon.

Continuing with FIGS. 5A and 5B, the yoke assembly 24 of this embodiment of the present invention comprises an above deck portion having a lattice arrangment of yoke assembly support members 25 and a substructure 26 interfaced with the vessel's longitudinal L, L' and transverse T, T' bulkheads to form a lifting cell C having a perimeter P, said lifting cell situated below deck 13', such that the yoke assembly 24 is structurally integrated into the vessel, with the yoke assembly support members 25 engaging the hull of the vessel in the vicinity of the leg passageway 6' for the leg 4'. Below the deck, the yoke assembly substructure 26 is reinforced by the vessel's longitudinal L and transverse T bulkheads.

Figure 5B:
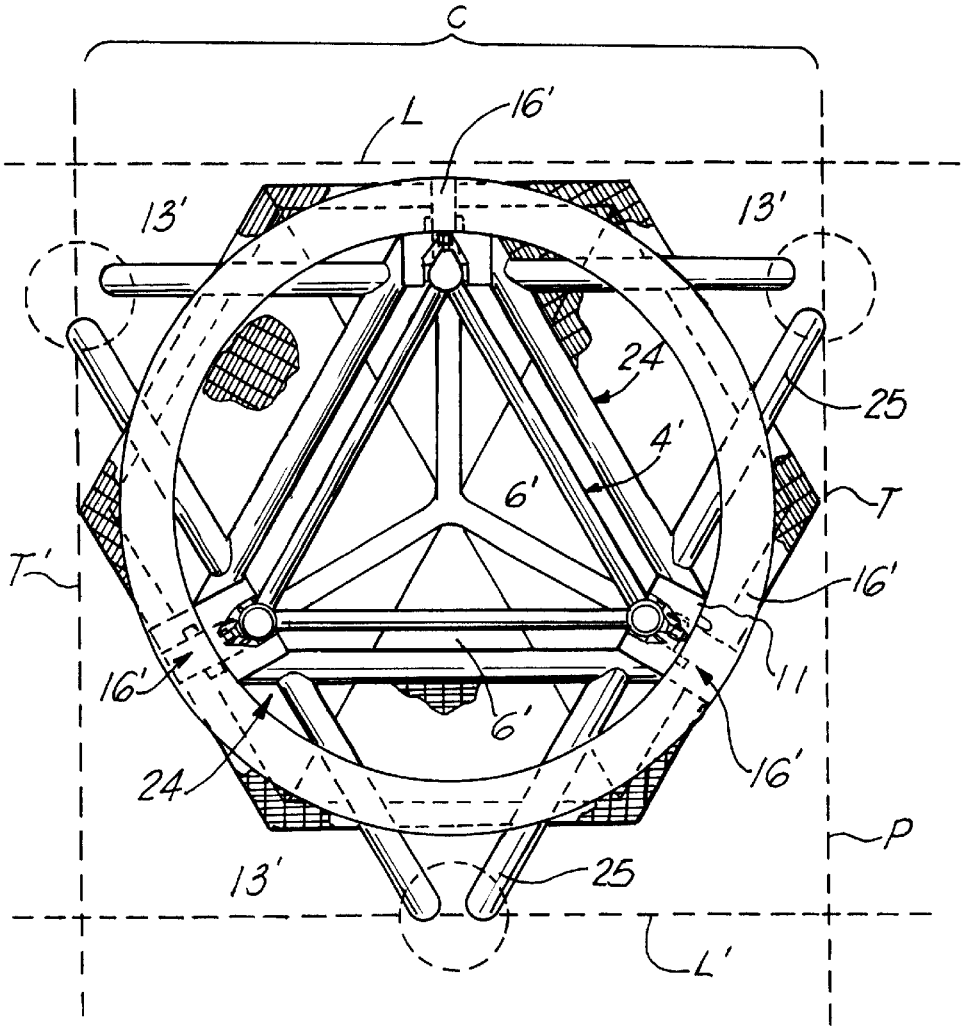
FIG. 5B is a top view of FIG. 5A, illustrating the ring beam for supporting a crane, and underlying yoke assembly and (in phantom) a load cell in the substructure of the vessel for receiving the yoke assembly in the form of conjoined longitudinal and transverse bulkheads and vertical support members.

Referring to FIG. 5B of the drawings, a top view of the lift crane support structure/yoke assembly 24 of the present invention is integrated into the deck 13' of a vessel such as a jack-up drilling rig, jack-up service vessel, barge, platform, or the like having legs 4' configured to engage the water bottom to lift the vessel above the water level, the legs 4' passing through lateral, enveloped passageways 6' formed through the deck 13' and hull of the vessel. To facilitate lifting or lowering of the legs 4', jacking units 11 are provided, generally within a gear case.

Figure 5C:
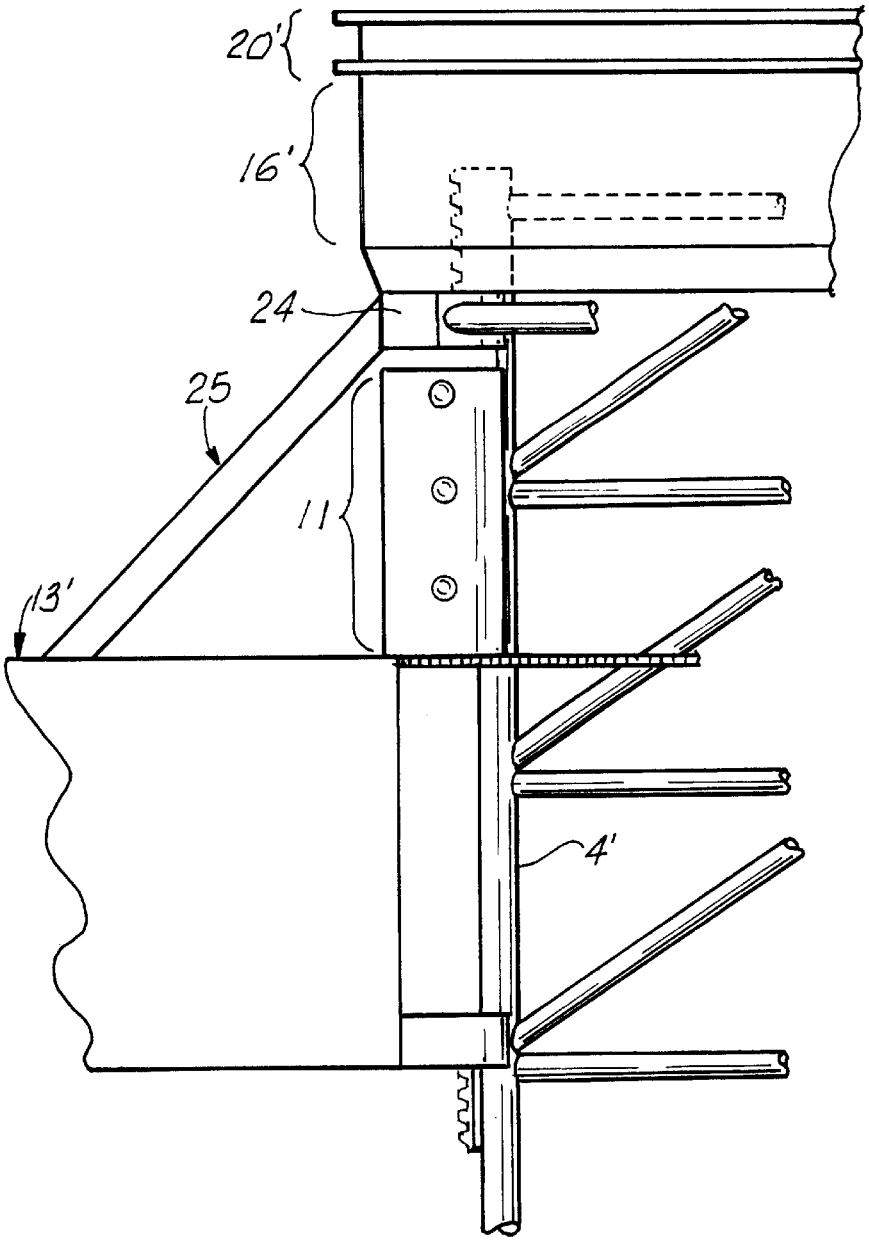
FIG. 5C is a side view of the invention of FIGS. 5A and 5B, illustrating the yoke assembly and interface with the substructure of the vessel.

As shown in FIG. 5C, the jacking units 11 are configured to engage the leg for vertical manipulation of same. Situated upon the top of yoke assembly 24 is a crane tub 16' having flange 20' situated thereupon., which flange is configured to support crane 10'. An exemplary crane which may be utilized with this system would be the AmClyde Unit Model 300ATL, a 300 Ton crane.

Continuing with FIG. 5C, which illustrates the top of the yoke assembly 24 and the engagement of the crane tub 16' cross-section of the yoke assembly support members 25, with the width of the yoke assembly 24 approximately coinciding with the diameter of the crane tub 16' so that the crane tub diameter rests upon the top of the yoke assembly 24.

The yoke assembly 24 and yoke support members 25 are reinforced via support members 25, which may comprise multiple structural members such as box/tubular beams, I-beams, T-beams, solid plate, or the like, running from the top of the yoke assembly 24, through the deck 13', and engaging the hull of the vessel.

As earlier indicated, a substructure 26 comprised of the vessel's longitudinal bulkheads, transverse bulkheads and stiffeners, diagonal braces or the like will be provided under the deck 13' to support the yoke assembly support members 25. Additional yoke assembly support members 25 may be provided for further structural support of the yoke assembly 24, tub 16' and crane 10'.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A system for providing a raised platform above the deck of a vessel having a deck and a hull, comprising:

a substructure situated between the hull and deck, said substructure comprising longitudinal bulkheads configured to laterally engage, in spaced fashion, transversal bulkheads and the hull so as to form a planar support cell having a perimeter;

an upper deck structure having upper and lower ends, said lower ends engaging said perimeter of said planar support cell through the deck;

a crane tub having a flange situated upon said upper end of said deck structure, said crane tub formed to support a crane thereupon.

2. The system of claim 1, wherein said upper deck structure comprises an extension of said lateral and longitudinal bulkheads so as to form vertical, planar walls extending through the deck so as to form a jack house.

3. The system of claim 1, wherein said upper deck structure comprises a plurality of braces in lattice configuration to form a truss assembly, said truss assembly having upper and lower ends, said lower end of said truss assembly resting upon said planar support cell, said upper end of said truss assembly supporting said crane tub.

4. A method of providing a raised platform above the deck of a vessel having a hull, comprising the steps of:

a. forming a substructure situated between the hull and deck, said substructure comprising longitudinal bulkheads configured to laterally engage, in spaced fashion, transversal bulkheads and the hull so as to form a planar support cell;

b. extending said portions of said lateral and longitudinal bulkheads forming said planar support cell through the deck of the vessel, providing an extension of the bulkhead emanating through the deck;

c. placing a crane tub upon said extension of said bulkhead emanating through the deck, so as to provide said object in spaced relation above said deck.

5. A method of providing a jack house on a vessel having a deck and a hull, comprising the steps of:

a. forming a substructure situated between the hull and deck, said substructure comprising longitudinal bulkheads configured to laterally engage, in spaced fashion, transversal bulkheads and the hull so as to form a planar support cell having a perimeter;

b. extending said portions of said lateral and longitudinal bulkheads forming said planar support cell through the deck of the vessel, providing an extension of the bulkhead emanating through the deck;

c. utilizing said extension of said bulkhead emanating through the deck to form walls, providing a jack house having a crane tub situated there upon.

6. The method of claim 5, wherein there is provided the further step "d" of placing a crane tub squarely upon said top of said jack house.

7. A method of providing a jack house on a vessel having a deck and a hull, comprising the steps of:

a. forming a substructure situated between the hull and deck, said substructure comprising longitudinal bulkheads configured to laterally engage, in spaced fashion, transversal bulkheads and the hull so as to form a planar support cell forming a perimeter;

b. providing a plurality of braces in lattice configuration to form a truss assembly, said truss assembly having upper and lower ends, said lower end of said truss assembly resting upon said perimeter of said planar support cell;

c. placing a crane tub upon said upper end of said truss assembly.

8. A crane support apparatus for supporting a crane on a jack-up vessel having a leg and a jacking unit, a deck and a hull, comprising:

a jack house having walls formed of vertical support members extending through the deck of said vessel, said vertical support members having first and second ends, said first ends engaging the hull of the vessel, said second ends forming the upper edge of the jack house, said walls of said jack house having a width, and an interior with a leg passageway formed therethrough, said jack house formed so as to accommodate a jacking unit configured to engage the leg of the vessel;

a pedestal having a circular cross-sectional configuration, a diameter and first and second ends, said diameter of said pedestal coinciding with said width of said jack house, said first end of said pedestal engaging said walls of said jack house, said second end of said pedestal having a flange mounted thereupon, said flange supporting and rotatingly engaging a crane;

wherein said vessel has longitudinal and transversal bulkheads formed in its substructure, and wherein said vertical support members comprise first and second vertical support members having a planar configuration, said first vertical support member integrated into said longitudinal bulkhead, said second vertical support member integrated into said transversal bulkhead, said first and second vertical support members engaged with said longitudinal bulkhead and said transversal bulkhead to form a support cell having a perimeter.

9. The crane support apparatus of claim 8, wherein there is further provided angled bracing having first and second ends, said first end engaging said hull of said vessel, said second end engaging said vertical support members.

* * * * *